United States Patent [19]

Washburn

[11] 4,139,845

[45] Feb. 13, 1979

[54] FLASHLIGHT BURGLAR ALARM APPARATUS

[76] Inventor: Alfred F. Washburn, 1448 Lakeshore Dr., Mount Dora, Fla. 32757

[21] Appl. No.: 793,191

[22] Filed: May 2, 1977

[51] Int. Cl.[2] ..... G08B 13/08

[52] U.S. Cl. ..... 340/546; 340/686

[58] Field of Search ..... 340/283, 282, 220

[56] References Cited

U.S. PATENT DOCUMENTS

| | | | |
|---|---|---|---|
| 3,171,109 | 2/1965 | Appel | 340/283 |
| 3,248,723 | 4/1966 | Miethe | 340/283 |
| 3,345,627 | 10/1967 | Herst et al. | 340/283 |
| 3,432,843 | 3/1969 | Spring | 340/546 |

*Primary Examiner*—Glen R. Swann, III

*Attorney, Agent, or Firm*—Duckworth, Hobby, Allen & Pettis

[57] ABSTRACT

A portable flashlight burglar alarm apparatus has a flashlight with an annunciator attached thereto and powered by the flashlight batteries. The flashlight may be placed adjacent a door and the burglar alarm circuit enabled so that opening the door knocks the flashlight over to actuate the annunciator.

9 Claims, 3 Drawing Figures

FLASHLIGHT BURGLAR ALARM APPARATUS

BACKGROUND OF THE INVENTION

The present invention relates to flashlights and especially to portable flashlights having a burglar alarm incorporated thereinto so that the flashlight may be used as a portable burglar alarm.

In the past, inexpensive flashlights, having a generally cylindrical shape have been provided having a lamp and a reflector and connected to batteries enclosed in the flashlight casing. These flashlights typically have a switch on the side of the casing for completing a connection between the lamp or bulb and the batteries to operate the flashlight. It has also been common in the past to provide a variety of burglar alarms, many of which are portable so that the owner can take the burglar alarm with him while staying in motels or hotels, or visiting in different households. Such portable alarms are typically actuated by the opening of a door such as by the turning of a door knob or the opening of a window to set off an annunciator to awaken the occupant of the room. A typical portable alarm for use for a window or door may be seen in U.S. Pat. No. 3,932,856, to Tremont, which alarm is contained in a box and may be positioned for actuation upon the opening of a door or a window or by a pull cord. It has also been suggested in the Appel U.S. Pat. No. 3,171,109, to combine a flashlight with a fire alarm and distress signal in which a fire alarm and signalling mechanism have been added to an existing flashlight. Similarly, the Potoroka U.S. Pat. No. 3,763,481, teaches the combining of a flashlight with a Fisherman's Temperature Locating Apparatus. One U.S. Pat. to Meyers, No. 2,893,344 teaches the combination of a flashlight and horn for attachment to a bicycle to provide visual and audible signals.

The present invention has the advantage of having a portable flashlight which may be carried with a traveler or used around the home which then doubles as a burglar alarm at night by simply actuating an enabling switch and positioning the flashlight adjacent or leaning it against a door or window. The present alarm may also be used as a personal protection alarm at night and used as a flashlight or may be attached to a trip string. Another advantage of the present invention is the inexpensive cost of manufacture by the use of conventional existing components.

SUMMARY OF THE INVENTION

The present invention relates to a portable flashlight burglar alarm apparatus having a conventional elongated cylindrical flashlight casing having a reflector and lamp at one end, batteries located in the casing, and a switch for actuating the flashlight. The casing has an annunciator attached thereto coupled through a burglar alarm circuit to the flashlight batteries and the flashlight switch includes an enabling switch for the burglar alarm. The flashlight may be placed adjacent a door entryway and the burglar alarm enabled so that upon being knocked over or allowed to fall, the annunciator will be actuated. A cushioning surface may be positioned so as to frictionally engage a door or window when the alarm is leaned thereagainst.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
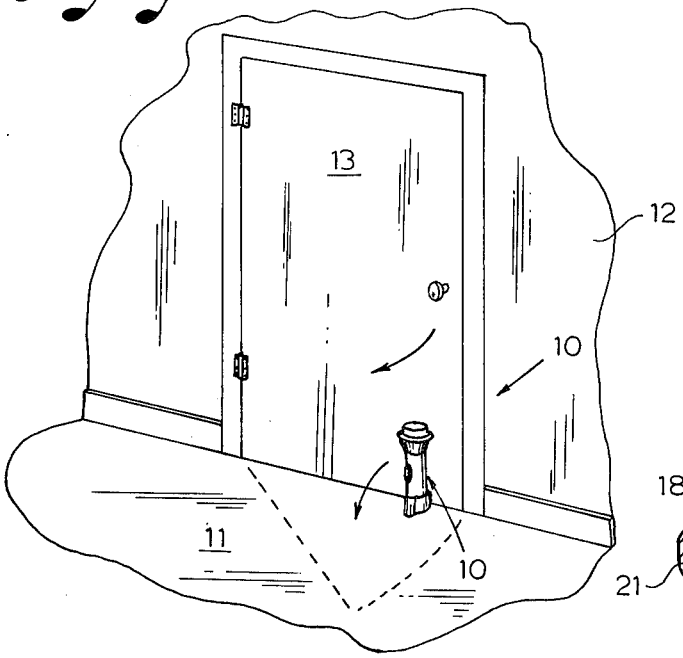
FIG. 1 is a perspective view of an entryway with a portable flashlight and burglar alarm in accordance with the present invention placed adjacent thereto.

Referring now to the drawings, FIG. 1 illustrates a portable flashlight burglar alarm 10 sitting on a floor 11 of a room having wall 12 and an entryway with a closed door 13. The flashlight burglar alarm 10 is positioned adjacent the door 13 in an upright position or leaning against the door 13 such that the opening of the door 13 will knock the burglar alarm 10 over onto the floor 11.

Figure 2:
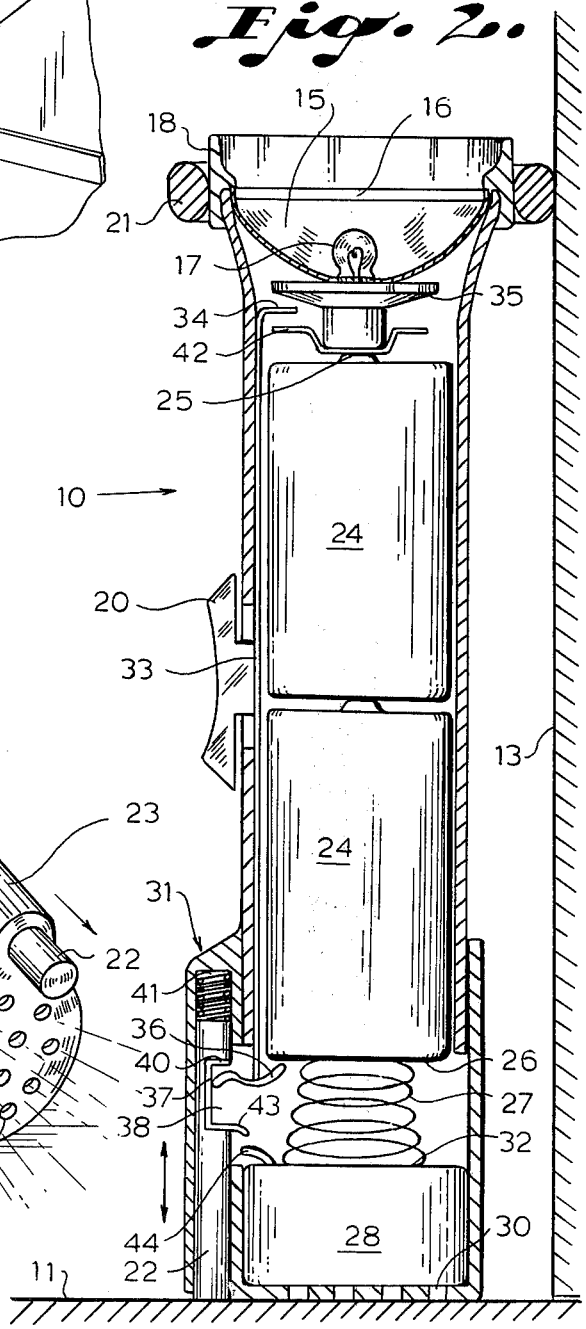
FIG. 2 is a sectional view of a portable flashlight burglar alarm in accordance with FIG. 1.
Figure 3:
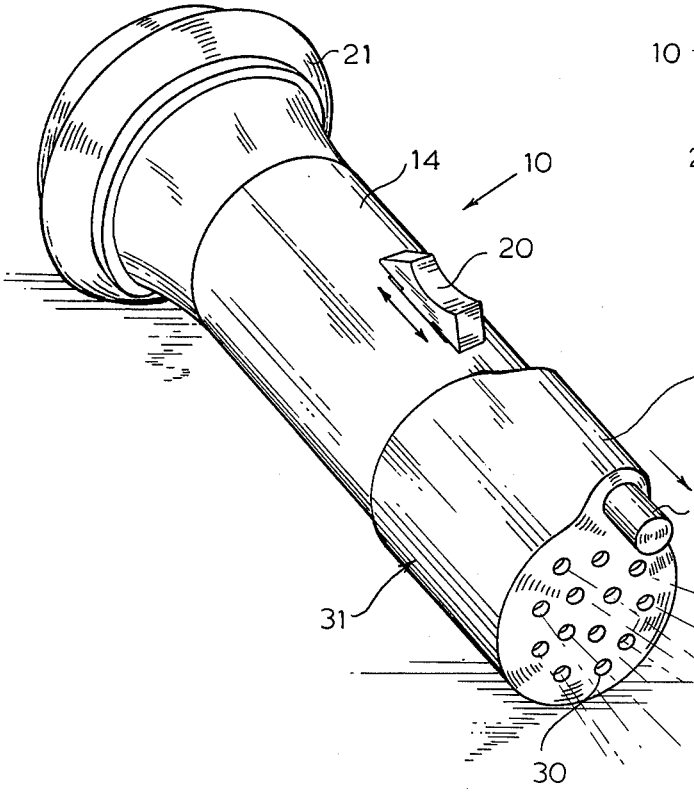
FIG. 3 is a perspective view of the flashlight burglar alarm of FIGS. 1 and 2.

The flashlight burglar alarm 10 is more clearly illustrated in FIGS. 2 and 3 as a standard flashlight casing 14 having a light reflector 15 mounted therein behind a lens 16 with a lamp or bulb 17 mounted in the reflector 15. The flashlight casing 14 has a screw-off top 18 for removing the lens 16 and bulb 17 and replacing the batteries. As with most conventional flashlights, a switch handle 20 is slidably mounted to the side of the flashlight. The present flashlight burglar alarm differs on the exterior by the bumper 21 which may be an annular resilient rubber member which will give a frictional engagement with a door 13 when leaned against if so that the flashlight will slide downwards if the door is opened or alternatively to provide cushioning for the flashlight burglar alarm 10 when the alarm falls on the floor 11. This also allows the flashlight alarm to be used against a sliding door. The exterior differs also in the protruding burglar alarm switch 22 and the portion of the housing 23 housing the switch 22. The flashlight 10 has a pair of conventional batteries 24 therein with the positive terminal 25 of one battery pushing against the base of the lamp 17 and the negative terminal 26 being supported by a compression spring 27.

As illustrated in FIG. 2, the end portion opposite the lamp 17 and reflector 15 houses an annunciator or alarm buzzer 28 of conventional design with its transducer facing a plurality of openings 30 on the end of the casing 14. The casing 14 includes a detachable end portion 31 having the annunciator 28 therein and a compression spring between the annunciator and the negative terminal 26 of one of the batteries 24. The compression spring 27 may, if desired, form a contact between the negative terminal 26 and a terminal 32 on the annunciator 28. Switching handle 20 has an elongated, flattened slide conductor 33 attached thereto and is adapted to switch between three positions: forward, center, and rearward. In the forward position, the elongated conductor 33 shifts a tab electrical contact 54 against an edge of a lamp support 35 and simultaneously brings a tab 36 at the opposite end of the elongated conductor 33 against the negative terminal 26 of one of the batteries 24, thereby completing a circuit from the negative terminal of the battery to the support 35 and therethrough to the lamp 17. The positive terminal 25 of the battery is positioned to make contact with the center contact of the lamp 17 at all times, thus completing a circuit by pushing the switch 20 turning a lamp 17 on to use the apparatus 10 as a flashlight. Moving the switch 20 forward also moves a tab electrical contact 37 to a forward position in a notch 38 and against a metal conductor member portion 40 to drive the burglar alarm switch member 22 against a spring 41 to pull the alarm member 22 into the casing end 31 when the light is turned on and also when the light switch 20 is centered, thereby turning the lamp and burglar circuit into a disabled position. Sliding a switch 20 to the center position moves the contact 36 from the negative contact 26 of the battery 24 to simultaneously remove the metal contact 34 away from the lamp support 35 thereby disconnecting the lamp 17. Shifting the switch 20 to its rearward position drives the contact tab 34 against an electrical contact 42 positioned adjacent the positive contact 25 of the battery 24, and simultaneously allows the contact tab 37 to slide rearward so as to free the switch member 22 to be driven by the spring 41 out of the casing. When the switch member 22 slides a sufficient distance out of the casing 31, a protruding tab portion 43 of the conductor 40 will engage an electrical contact 44 of an annunciator 28 while the contact 37 is also in contact with the conductor 40 thereby completing a circuit from the positive terminal 25 of the battery through the contact 42 and 34 through the elongated conductor 33, contact 37, metal conductor 40 and contact 44 thereby actuating the annunciator 28. However, when the burglar alarm 10 is enabled the light would be positioned as shown in FIG. 1 standing up, thereby supporting the switch member 22 in the casing and preventing contact 43 from engaging contact 44 unless the flashlight burglar alarm 10 were knocked over by the door 13, thereby allowing the switch member 22 to slide outward, making contact between contacts 43 and 44.

It should be clear at this point that a portable flashlight and burglar alarm have been provided which can be used as a flashlight and quickly converted to a burglar alarm and readily transportable with a traveler for use in a variety of situations, such as motel and hotel rooms as well as in the home. It should, however, also be clear that variations are contemplated as being within the scope of the invention, such as having the casing 14 made out of a variety of materials, such as various polymers as well as metals and that most of the components are readily available as existing items including the flashlight casing 14, the annunciator 28, and all the flashlight components and batteries 24. Accordingly, the present invention is not to be construed as limited to the particular forms as disclosed herein which are to be regarded as illustrative rather than restrictive.

I claim:

1. A portable flashlight burglar alarm apparatus comprising in combination:

a flashlight having a casing, battery means located in said casing, a switch, and a lamp operatively connected to said battery means through said switch;

an annunciator attached to said casing and coupled to said battery means;

an alarm switch coupled between said battery means and said annunciator for actuating said annunciator responsive to said alarm switch being actuated, and an annular resilient bumper attached to said flashlight casing for providing a frictional engagement with an entry door, whereby a flashlight can be used as a burglar alarm.

2. The apparatus in accordance with claim 1, in which said flashlight switch is a three-way switch for disabling said flashlight and annunciator in one position, actuating said flashlight and disabling said annunciator in a second position, and enabling said annunciator alarm switch and disabling said flashlight in a third position.

3. The apparatus in accordance with claim 2, in which said alarm switch is a spring-loaded sliding switch member, which may be supported in said casing when said casing is positioned in an upright position, and which is allowed to slide for actuating said annunciator when said casing is knocked from its upright position.

4. The apparatus in accordance with claim 3, in which said spring-loaded, sliding alarm switch has a notch therein for engaging a conductive electrical contact operatively coupled to the three-way switch for supporting said sliding switch member against its spring bias for disabling said annunciator alarm switch.

5. The apparatus in accordance with claim 4, in which said flashlight casing is a cylindrical flashlight casing having a detachable end portion containing the annunciator and alarm switch.

6. The apparatus in accordance with claim 5, in which the electrical contact operatively coupled to said switch and positioned in a notch in said sliding alarm switch retracts said sliding alarm switch to disable said alarm switch when said flashlgiht is actuated.

7. The apparatus in accordance with claim 6, in which an electrical contact is connected to a lamp support for said lamp for providing a positive contact for a conductor connected to said three-way switch when said three-way switch is shifted to its annunciator enabling position.

8. The apparatus in accordance with claim 7, in which said casing detachable end portion has openings therein to produce an audible alarm from said annunciator when said annunciator is actuated.

9. The apparatus in accordance with claim 8, in which said three way switch has a second electrical contact thereon for contacting a negative contact of said battery means for completing a circuit to said lamp when said three-way switch is in its lamp-on position.

* * * * *

UNITED STATES PATENT AND TRADEMARK OFFICE

CERTIFICATE OF CORRECTION

PATENT NO. : 4,139,845

DATED : Feb. 13, 1979

INVENTOR(S) : Alfred F. Washburn

It is certified that error appears in the above-identified patent and that said Letters Patent are hereby corrected as shown below:

Column 2, line 55, "54" should read -- 34 --.

Signed and Sealed this

*Eleventh* Day of *September 1979*

[SEAL]

*Attest:*

LUTRELLE F. PARKER

*Attesting Officer* *Acting Commissioner of Patents and Trademarks*